US005509153A

United States Patent [19]

Roschacher

[11] Patent Number: 5,509,153

[45] Date of Patent: Apr. 23, 1996

[54] ANATOMICAL AIR MATTRESS

[76] Inventor: Eugen Roschacher, Weinbergstrasse 95, CH-8006 Zürich, Switzerland

[21] Appl. No.: 256,626

[22] PCT Filed: Jan. 18, 1993

[86] PCT No.: PCT/EP93/00106

§ 371 Date: Aug. 17, 1994

§ 102(e) Date: Aug. 17, 1994

[87] PCT Pub. No.: WO93/14676

PCT Pub. Date: Aug. 5, 1993

[30] Foreign Application Priority Data

Jan. 28, 1992 [CH] Switzerland ..... 00232/92
Jul. 23, 1992 [DE] Germany ..... 9209937 U

[51] Int. Cl.[6] ..... A47C 27/08

[52] U.S. Cl. ..... 5/449; 5/900.5; 5/461

[58] Field of Search ..... 5/449, 461, 462, 5/468, 656, 900.5

[56] References Cited

U.S. PATENT DOCUMENTS

| | | | |
|---|---|---|---|
| 1,548,728 | 8/1925 | Milam | 5/462 |
| 3,132,899 | 5/1964 | Render | 5/656 X |
| 3,363,272 | 1/1968 | Channon | 5/656 X |
| 4,054,960 | 10/1977 | Pettit et al. | 5/900.5 X |
| 4,665,573 | 5/1987 | Fiore | 5/900.5 X |
| 4,972,535 | 11/1990 | Goldman | 5/900.5 X |
| 5,224,226 | 7/1993 | Groenewald | 5/900.5 X |

*Primary Examiner*—Michael F. Trettel
*Attorney, Agent, or Firm*—Birch, Stewart, Kolasch & Birch

[57] ABSTRACT

An anatomically shaped mattress is disclosed which includes a top surface, a substantially planar bottom surface, a face end, a foot end, and two opposing lateral sides connecting the face end to the foot end. A substantially planar central section which is parallel to the bottom surface is provided for receiving a chest and stomach of a person in a reclined position. A recess is transversely formed between the two lateral sides and adjoining the central section adjacent the face end. A rest area is provided adjoining the recess on a face end side thereof for receiving a forehead of the reclined person. A spacing from the bottom surface is greater than the spacing of the base of the recess from the bottom surface but less than the spacing of the central section from the bottom surface. An end section adjoins the rest area adjacent the face end, and a spacing from the bottom surface thereof at least corresponds to that of the central section from the bottom surface. A hollow portion adjoins the central section adjacent the foot end and extends partially over the width of the air mattress for accommodating legs of the reclined person, such that the foot end of the hollow has a spacing from the bottom surface which substantially corresponds to that of the central section.

7 Claims, 2 Drawing Sheets

ANATOMICAL AIR MATTRESS

BACKGROUND OF THE INVENTION

1. Field of the Invention

The present invention is directed to an anatomically shaped air mattress, and more particularly to an anatomically shaped air mattress including pre-formed depressions for accommodating various anatomical features.

2. Description of Related Art

On a conventional air mattress, it is practically impossible to assume a comfortable body position which allows for unrestricted breathing when tanning one's back while lying face down. If one wants to keep the nose free in order to obtain unrestricted breathing, one is forced to cross one's arms under the forehead with the result that the neck and arms ache after a short time as the head is pressed into the neck and the arms are pressed upwards inside the shoulders. Additionally, the back starts to ache after lying on the front for some time, as, due to the flat horizontal base, the spinal column is forced into the position of a "hollow back". And finally, the legs and toes ache too, as they have to be bent sideways to avoid a perpendicular and therewith painful positioning on the base.

SUMMARY OF THE INVENTION

Conventional air mattresses are uncomfortable to lie on, if one wants to tan one's back. The present invention intends to remove this disadvantage. This object is achieved by a combination of the features of the claims.

BRIEF DESCRIPTION OF THE DRAWINGS

Subsequently a representative embodiment of the invention is illustrated with reference to the figures wherein.

DETAILED DESCRIPTION OF PREFERRED EMBODIMENTS

Figure 1:
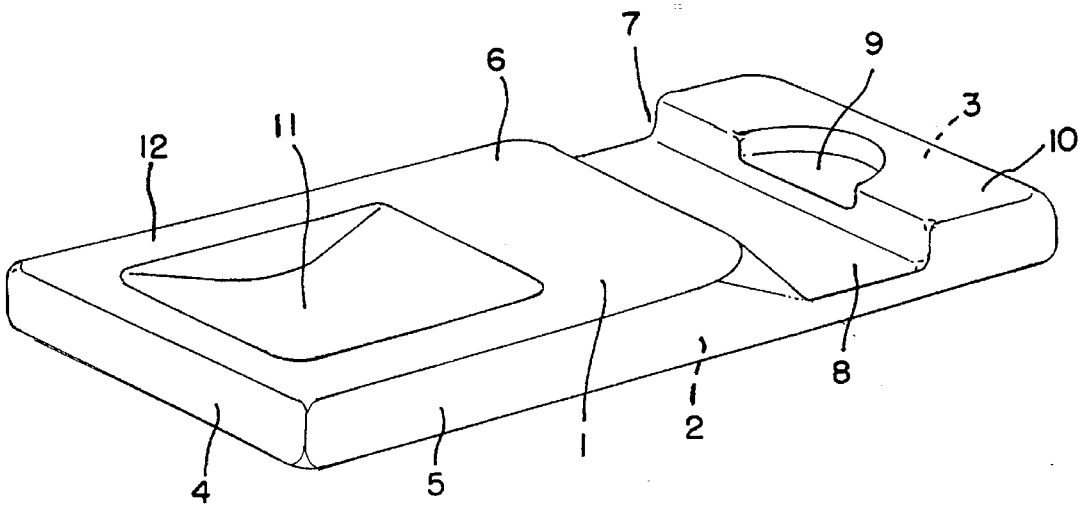
FIG. 1 is a perspective view of an anatomically shaped air mattress.

The anatomically shaped air mattress illustrated in the drawings has a top surface 1, an approximately planar bottom surface 2, an end face 3 on a head end, an end face 4 on a foot end and two lateral sides 5. The top surface 1 has an approximately planar central section 6 for the resting of the chest and stomach of a lying person which extends approximately parallel to the bottom surface 2 and is spaced apart from both end faces 3, 4. In its head section the top surface 1 has an arc-shaped depression with a rest 9 for the forehead. This rest 9 lies deeper than the central section 6. The end section 10 which surrounds the rest 9 lies level with or slightly higher than the central section 6. Between the rest 9 and the central section 6 a recess 7 extends transversely of the lateral sides 5, the base 8 of which lies deeper than the rest 9. Adjoining the central section 6 towards the foot side, a hollow 11 for the accommodation of the legs extends partway across the width of the anatomically shaped air mattress. The foot side end of the hollow 11 and both lateral sections 12 to the side of the hollow 11 are of the same height as the central section 6. The central section 6 has a slope 13 towards the recess 7 on both the sides.

In order to achieve the described shape of the top surface 1 of the air anatomically shaped mattress, the top surface 1 and the bottom surface 2 are connected with each other in a known manner by means of longitudinal and/or lateral walls and/or by means of pipelike intermediate parts and/or stitchings. Of these connections, a lateral wall 15 in the hollow 11 is represented only diagrammatically. Evidently the top and bottom surfaces 1, 2 are slightly vaulted between these connections. The above-applied term "planar" is thus to be understood to the meaning.

Figure 2:
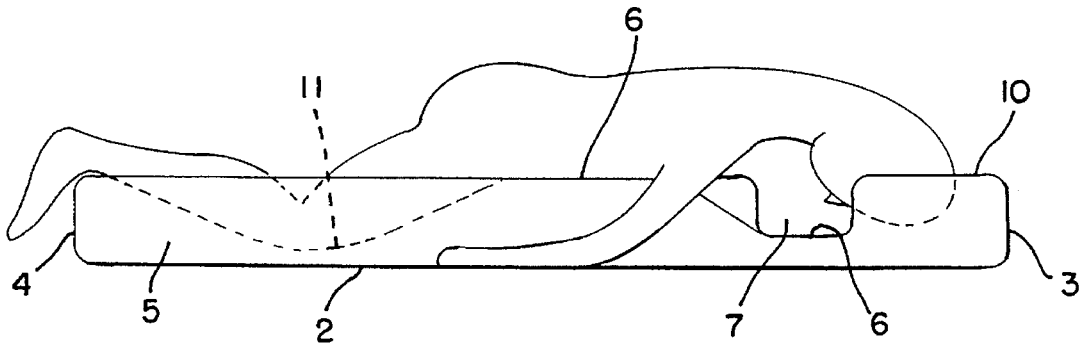
FIGS. 2 and 3 are side views of the air mattress with a person lying thereon.
Figure 3:
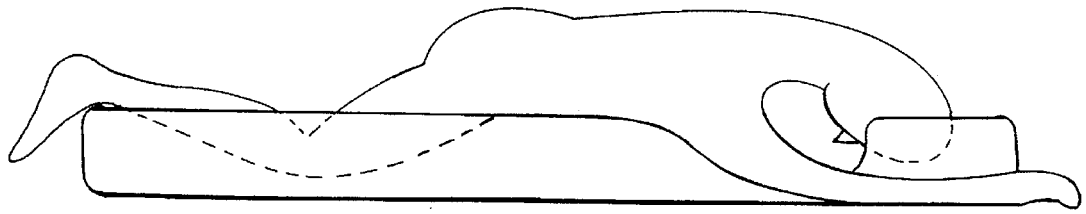

As is illustrated in FIGS. 2 and 3, the described form of the anatomically shaped air mattress makes possible an entirely relaxed resting on the stomach on the top surface 1. The cervical column is noticeably relieved due to the lower positioning of the rest 9; thus a neckache is completely avoided. Due to the recess 7 the entire face (with the exception of the forehead), in particular the nose, is kept free and is surrounded by fresh air. Thereby a completely unrestricted breathing is achieved and sweating in the face, where it is most unpleasant, is avoided or at least noticeably reduced. The legs are slightly angled because of the hollow 11, thereby resulting in an unstiffened, naturally bent spinal column (no "hollow back"), so that a back ache is avoided. Moreover, the hollow 11 has the advantage that, due to the inclination of the lower legs, the feet can be held in their natural position and the toes do not touch the ground. Foot and toeache is thus prevented. Because of the inclinations 13, the arms are slightly angled and can rest comfortably on the sides of the air mattress, turned either upwards or downwards (tanning of the lower sides of the arms).

If one wants to lie on the back or on the side, the anatomically shaped air mattress is turned over so that the approximately planar bottom side 2 is on top.

Figure 4:
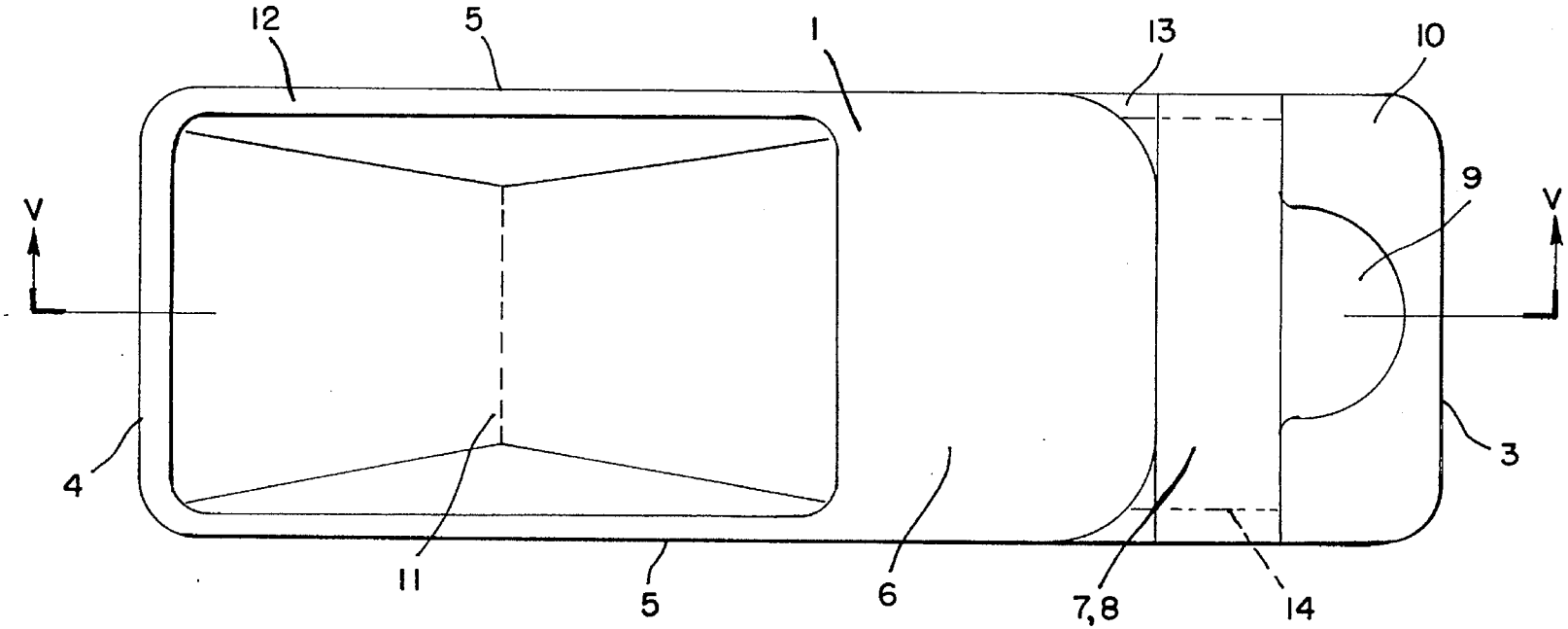
FIG. 4 is a top view of the air mattress according to FIG. 1.
Figure 5:
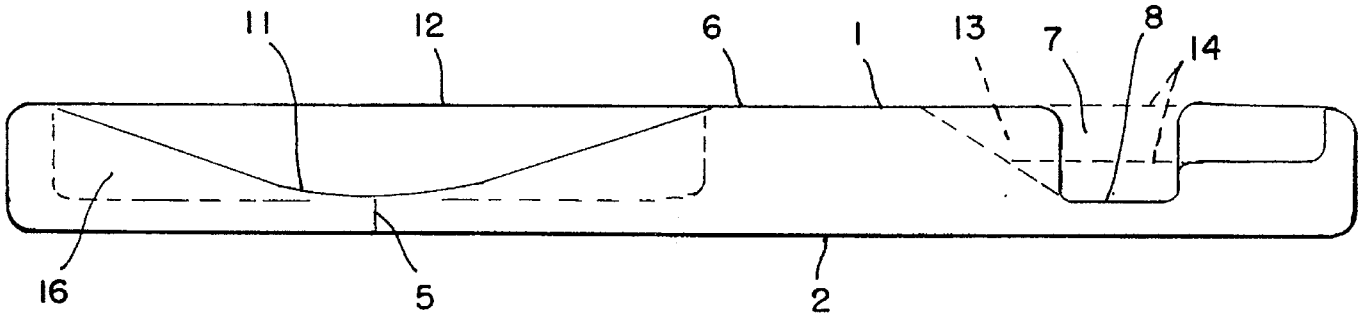
FIG. 5 is a section along the line V—V in FIG. 4.

In case the anatomically shaped air mattress is to be used in the water also, it can be expedient to partly or completely close the air recess 7 laterally with bridges 14 as is indicated in FIGS. 4 and 5 by dotted lines. Thereby the nose can be kept safely dry and the air mattress obtains a greater stability.

It my also be expedient for reasons of technical manufacturing that the hollow 11 has one depth 16 over its entire length, as is indicated in FIG. 5 by dotted lines, and that this depth approximately corresponds with the spacing of the base 8 of the recess 7 from the top surface 6. This not only prevents a resting of the upper and lower legs of the user on the air mattress and thus also prevents increased sweating of the legs, but also gives the anatomically shaped air mattress a simpler, more harmonious design.

By means of the anatomically shaped air mattress according to the invention, physical complaints which result from lying on the front are not only prevented but also eased. As the appropriate anatomical shape of the air mattress leads to a noticeable relief of the cervical and spinal column, the air mattress is of great help in particular for people suffering from backache and rheumatism. Even people who merely have a "weak" back—which quickly tires and aches—will welcome the new air mattress for an occasional relaxing thereupon. The air mattress can also be used as a mattress rest on the sofa or elsewhere indoors.

I claim:

1. An anatomically shaped air mattress with a top surface, a substantially planar bottom surface, a face end, a foot end, and two opposing lateral sides connecting the face end to the foot end, said air mattress comprising:

a substantially planar central section which is parallel to the bottom surface for for receiving a chest and stomach of a person in a reclined position;

a recess transversely formed between the two lateral sides and adjoining the central section adjacent the face end;

a rest area adjoining the recess on a face end side thereof arranged for receiving the forehead of the reclined person, a spacing from the bottom surface being greater than the spacing of the base of the recess from the bottom surface but less than the spacing of the central section from the bottom surface;

an end section adjoining the rest area and formed adjacent a face end, a spacing from the bottom surface at least corresponding to that of the central section from the bottom surface; and a hollow portion adjoining the central section adjacent the foot end extends partially over the width of the air mattress for the accommodation of the legs of the reclined person, whereby the foot end of the hollow has a spacing from the bottom surface which substantially corresponds to that of the central section.

2. The anatomically shaped air mattress according to claim 1, wherein the rest area is formed as an arc-formed depression of the end section.

3. The anatomically shaped air mattress according to claim 1, wherein the top surface has one lateral section respectively on each of the two sides of the hollow, which section has substantially the same spacing from the bottom surface as the central section.

4. The anatomically shaped air mattress according to claim 1, wherein the central section between the two lateral sides is sloped towards the recess.

5. The anatomically shaped air mattress according to claim 1, wherein the recess is closed on both sides with a bridge which extends substantially the height of the rest area.

6. The anatomically shaped air mattress according to claim 1, wherein the recess is closed on both sides with a bridge, the height of which extends from the bottom surface to the top surface.

7. The anatomically shaped air mattress according to claim 1, wherein the hollow has one depth over its entire length, whereby this depth substantially corresponds to the spacing of the base of the recess from the top surface.

* * * * *